US005167188A

United States Patent [19]

Lindblom

[11] Patent Number: 5,167,188

[45] Date of Patent: Dec. 1, 1992

[54] PORTABLE INK FOUNTAIN INSERT FOR A PRINTING PRESS

[75] Inventor: Kurt L. Lindblom, Trollhättan, Sweden

[73] Assignee: Man Miller Druckmaschinen GmbH, Geishenheim, Fed. Rep. of Germany

[21] Appl. No.: 751,994

[22] Filed: Aug. 29, 1991

[30] Foreign Application Priority Data

Aug. 30, 1990 [DE] Fed. Rep. of Germany ..... 4027377

[51] Int. Cl.[5] ..... B41F 31/02

[52] U.S. Cl. ..... 101/364; 101/210; 101/330; 101/340; 101/347

[58] Field of Search ..... 101/364, 210, 330, 340, 101/347, 363, 350, 208, 207

[56] References Cited

U.S. PATENT DOCUMENTS 512,562 1/1894 Moore ..... 101/210

3,561,360 2/1971 Branfield et al. ..... 101/350

*Primary Examiner*—Edgar S. Burr

*Assistant Examiner*—Anthony H. Nguyen

*Attorney, Agent, or Firm*—Spencer, Frank & Schneider

[57] ABSTRACT

A portable ink fountain insert for an ink fountain of a printing press includes a body defining a volume for receiving ink, with a discharge gap being defined at the lower front end of the body. A pull is cable guided in a recess in the front wall. A gap control device is connected to the body and to the pull cable for selectively opening and closing the ink discharge gap in response to displacement of the pull cable. An actuating element engages the pull cable for controlling displacement of the pull cable and thus the opening and closing of the discharge gap.

5 Claims, 2 Drawing Sheets

PORTABLE INK FOUNTAIN INSERT FOR A PRINTING PRESS

CROSS REFERENCE TO RELATED APPLICATIONS

The present application claims the rights of priority with respect to application Ser. No. P 40 27 377.6 filed Aug. 30, 1990 in Germany, the subject matter of which is incorporated herein by reference.

BACKGROUND OF THE INVENTION

This invention relates to a portable ink fountain insert for an ink fountain of a printing press.

An ink fountain is usually a structural component of an inking mechanism of a printing press and is thus usually fixed to the inking mechanism. A change of ink is usually possible only after the ink in the ink fountain has been completely spent, unless one is willing to incur the great expense of cleaning the partially filled ink fountain.

U.S. Pat. No. 512,562 discloses a portable ink fountain insert for an ink fountain of a printing press wherein the insert includes a front wall and an ink discharge gap at the lower front end of the ink fountain insert closable by a mechanism which includes a threaded rod extending along an interior face of the front wall. The threaded rod is actuated by a screwed-on threaded nut. This prior art structure is not only complicated and structurally expensive, but also has the grave defect that the mechanism for actuating the closing element comes into contact with the ink of the ink fountain and thus is difficult to clean.

SUMMARY OF THE INVENTION

It is an object of the invention is to provide a portable ink fountain insert which meets all requirements of practicality, particularly with respect to cleanliness, and also has a simple structure.

The above and other objects are accomplished according to the invention, by a portable ink fountain insert for an ink fountain of a printing press comprising: a body defining a volume for receiving ink and including a front wall and a bottom which together with the front wall defines an ink discharge gap at a lower front end of the body, the front wall having a recess; a pull cable guided in the recess; gap control means connected to the body and to the pull cable for selectively opening and closing the ink discharge gap in response to displacement of the pull cable; and actuating means engaging the pull cable for controlling displacement of the pull cable.

To use the portable ink fountain insert of the invention with a printing press it is only necessary to fill the portable ink fountain insert with the desired ink, insert the filled portable ink fountain insert into the desired inking mechanism, and open the ink discharge gap. A change of ink is easily accomplished by exchanging portable ink fountain inserts, and performing a minimal amount of cleaning work.

Opening and closing the ink discharge gap is controlled by a pull cable which acts on the gap control mechanism which is preferably in the form of a flexible spring metal sheet attached to the bottom wall of the insert. The pull cable is preferably provided with a handle which can be U-shaped. When the metal sheet is in its rest position, the ink discharge gap is open and ink can flow onto a ductor cylinder. If the handle is lifted, the metal sheet is bent out of its rest position and is moved into a closed position so that a front edge of the metal sheet rests against a contact face located in a region of a lower edge of the front wall, thus closing the ink discharge gap.

Since the pull cable is guided in the recess in the front wall, the pull cable is always maintained in a proper operating position, and is well protected.

The front edge of the metal sheet and the contact face have corresponding profiles so that in the closed position they cooperate to form a perfect seal which can possibly be reinforced by a rubber gasket at one or both of the contact face and the front edge of the metal sheet.

The invention will now be described in greater detail with reference to the drawing figures from which further significant features will become evident.

DETAILED DESCRIPTION OF PREFERRED EMBODIMENTS

Figure 1:
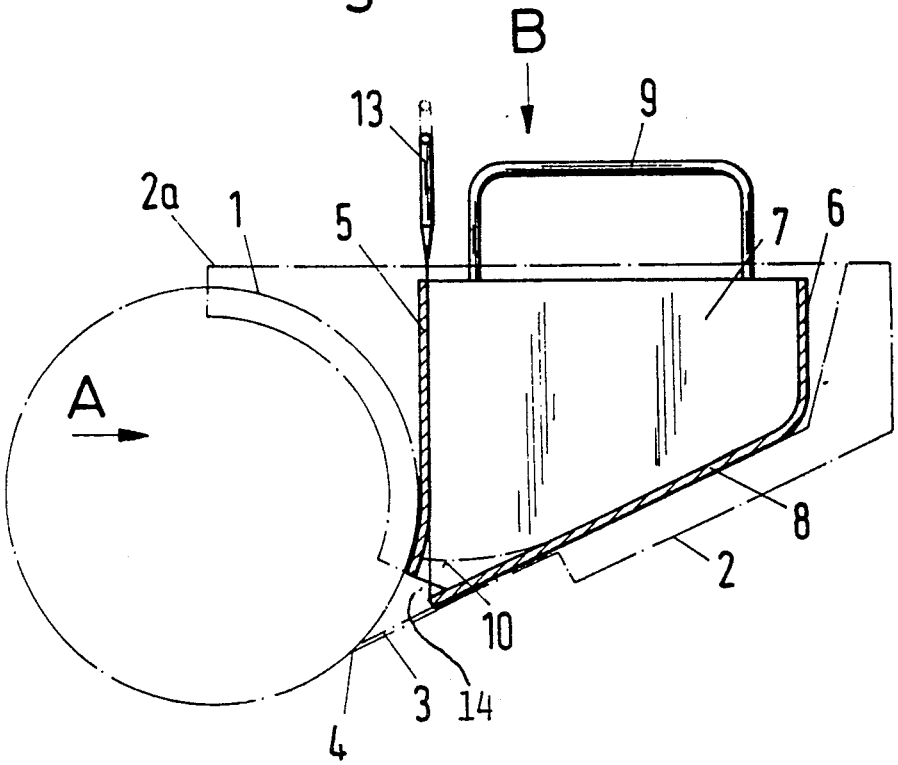
FIG. 1 is a schematic, partially sectional side view of one embodiment of the invention, shown as inserted into the inking mechanism of a web-fed printing press.

Referring to FIG. 1, there is shown a conventional inking mechanism of a printing press. The inking mechanism includes a conventional ink fountain 2, having a side wall 2*a*, for transferring ink to a ductor cylinder 1. A portable ink fountain insert, having a front wall 5, a rear wall 6, side walls 7, an inclined bottom 8, and being open at the top for receiving an ink supply, is inserted into ink fountain 2. Handles 9 are fastened to side walls 7 (see FIG. 3). An ink discharge gap 14 is defined between front wall 5 and bottom 8, and can be opened and closed by action of a metal sheet 10, preferably a flexible spring metal sheet.

Figure 2:
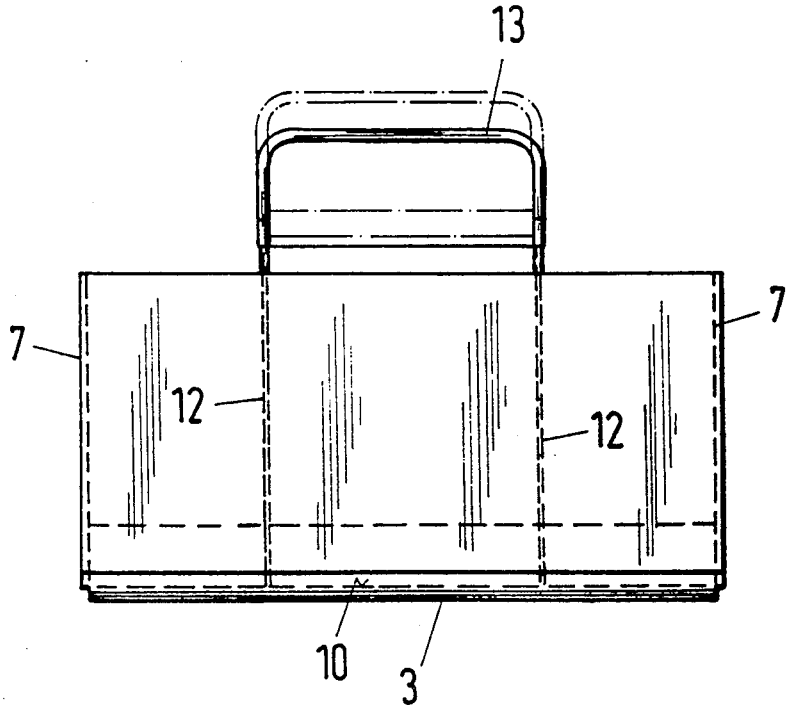
FIG. 2 is a front view of the embodiment shown in FIG. 1, seen in the direction of arrow A of FIG. 1.
Figure 3:
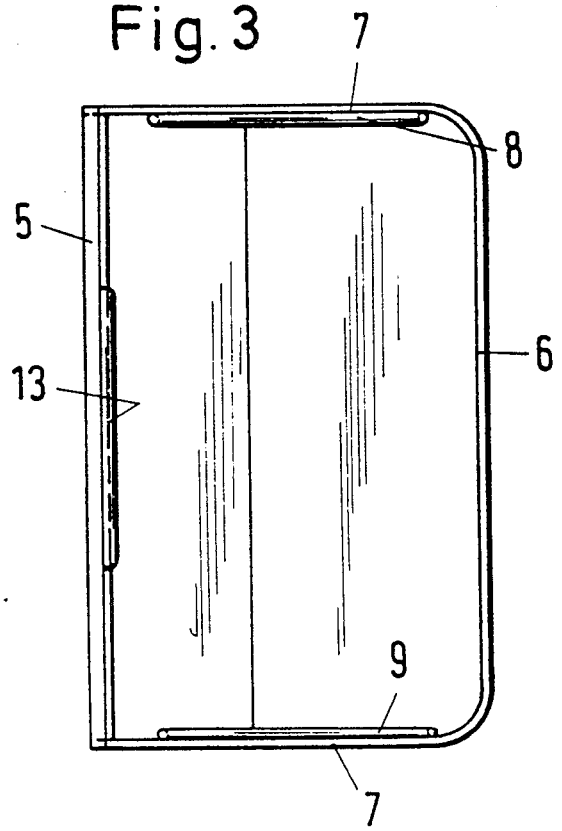
FIG. 3 is a top view of the embodiment shown in FIG. 1 seen in the direction of arrow B of FIG. 1.

When ink discharge gap 14 is closed, the portable ink fountain insert, which is shown as a whole in FIGS. 2 and 3, can be filled with printing ink. When ink discharge gap 14 is open, a film of printing ink 4 is transferred in a conventional manner to ductor cylinder 1 by a blade 3 which is provided at the bottom of ink fountain 2. When the printing ink is used up completely or partly, the ink discharge gap 14 can be closed and the portable ink fountain insert can be removed.

Figure 4:
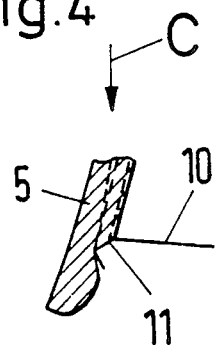
FIG. 4 is an enlarged side view of the lower region of the front wall, showing where the front edge of the metal sheet meets the contact face when the ink discharge gap is closed.
Figure 5:
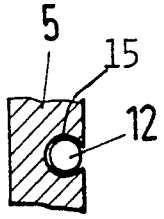
FIG. 5 is a top view of the front wall seen in the direction of arrow C of FIG. 4, showing the pull cable in the recess, with the metal sheet being omitted for the sake of clarity.

For this purpose, front wall 5 has two recess 15, one of which is shown in FIG. 5, for guiding two pull cables, respectively, which are connected at their ends to metal sheet 10. The two pull cables are connected together by way of a handle 13, which can be configured as a U-shaped handle, as shown in FIG. 4.

When ink discharge gap 14 is open, metal sheet 10 rests on a frontal region of bottom 8. To close ink discharge gap 14, handle 13 is lifted which displaces pull cables 12 and metal sheet 10 so that a profiled front edge 11 of metal sheet 10 is moved into contact with a correspondingly profiled contact face located in a lower edge region of front wall 5, as shown in FIG. 4.

The ink discharge gap has sufficient length to be used in conjunction with printing one or several pages of a book.

The described measures permit easy and clean manipulation of the printing ink.

The described portable ink fountain insert can be used in all machines employing ink fountains with an inking blade at the bottom, independently of whether they are web-fed or sheet-fed printing presses or offset or letter press printing presses.

The invention offers a particularly economical advantage to machines that can require a quick change of ink, for example, rotary newsprint or web-fed printing presses.

An air gap must be maintained between the front wall 5 and ductor cylinder 1. This air gap can be ensured by a continuous traverse rod between lateral cheeks of the ink fountain 2 or appropriate stops. Also conceivable are supports having a low coefficient of friction which lie directly against ductor cylinder 1.

Obviously, numerous and additional modifications and variations of the present invention are possible in light of the above teachings. It is therefore to be understood that within the scope of the appended claims, the invention may be practiced otherwise than as specifically claimed.

What is claimed is:

1. A portable ink fountain insert for an ink fountain of a printing press comprising:

a body defining a volume for receiving ink and including a front wall and a bottom which together with said front wall defines an ink discharge gap at a lower front end of said body, said front wall having a recess;

a pull cable guided in said recess; said recess protecting said pull cables from contact with ink contained in said ink fountain;

gap control means connected to said body and to said pull cable for selectively opening and closing said ink discharge gap in response to displacement of said pull cable; and actuating means engaging said pull cable for controlling displacement of said pull cable.

2. A portable ink fountain insert as defined in claim 1, wherein said gap control means comprises a flexible spring metal sheet with a profiled front edge, and said front wall has a correspondingly profiled contact surface in a region of a lower edge of said front wall so that when said profiled front edge is placed against said correspondingly profiled contact surface said ink discharge gap is closed.

3. A portable ink fountain as defined in claim 2, wherein and said actuating means comprises a U-shaped handle having ends that are connected to said pull cable for actuating said flexible spring metal sheet by displacement of said pull cable.

4. A portable ink fountain as defined in claim 1, wherein said gap control means includes biasing means for biasing said cable in a first direction for placing said gap control means in a normally open position and said actuating means pulls said cable is a second direction opposite to said first direction for closing said gap control means.

5. A portable ink fountain as defined in claim 4, wherein said gap control means includes a flexible spring metal sheet having one end attached to said bottom and a second end attached to said pull cable, said flexible spring metal sheet also constituting said biasing means whereby when said flexible spring metal sheet is in a relaxed state, said second end is separated from said front wall to form said ink discharge gap.

* * * * *